US008272142B2

(12) United States Patent
Hall

(10) Patent No.: US 8,272,142 B2
(45) Date of Patent: Sep. 25, 2012

(54) HAIR DRYER

(75) Inventor: Jeffrey P. Hall, Naples, FL (US)

(73) Assignee: Vexpro, LLC, Naples, FL (US)

( * ) Notice: Subject to any disclaimer, the term of this patent is extended or adjusted under 35 U.S.C. 154(b) by 1 day.

(21) Appl. No.: 12/895,938

(22) Filed: Oct. 1, 2010

(65) Prior Publication Data

US 2011/0079239 A1 Apr. 7, 2011

Related U.S. Application Data

(60) Provisional application No. 61/247,987, filed on Oct. 2, 2009.

(51) Int. Cl.
*A45D 20/12* (2006.01)

(52) U.S. Cl. ..... 34/96; 34/97; 132/271; 392/384; 392/385

(58) Field of Classification Search ..... 34/96, 97; 392/384, 385; 132/271
See application file for complete search history.

(56) References Cited

U.S. PATENT DOCUMENTS

| | | | | | |
|---|---|---|---|---|---|
| 1,751,573 | A * | 3/1930 | bishinger | ..... | 34/96 |
| 2,430,751 | A * | 11/1947 | Woodyard et al. | ..... | 34/97 |
| 3,584,632 | A * | 6/1971 | Weidner et al. | ..... | 132/271 |
| 3,724,092 | A * | 4/1973 | McCleerey | ..... | 34/99 |
| 4,486,961 | A * | 12/1984 | Giesselbach et al. | ..... | 34/80 |
| 4,904,847 | A * | 2/1990 | Kosaka et al. | ..... | 392/384 |
| 4,936,027 | A | 6/1990 | Tsuji | | |
| 5,103,577 | A * | 4/1992 | Michaels et al. | ..... | 34/91 |
| 7,184,655 | B2 * | 2/2007 | Dehli | ..... | 392/380 |
| D560,030 | S | 1/2008 | Welch et al. | | |
| 7,584,759 | B2 | 9/2009 | Yasuda et al. | | |
| 2004/0020070 | A1 | 2/2004 | Ito | | |
| 2004/0047620 | A1 * | 3/2004 | Ruben | ..... | 392/385 |
| 2006/0027551 | A1 * | 2/2006 | Dehli | ..... | 219/217 |
| 2011/0079239 | A1 * | 4/2011 | Hall | ..... | 132/271 |

* cited by examiner

*Primary Examiner* — Stephen M. Gravini
(74) *Attorney, Agent, or Firm* — Porter, Wright, Morris & Arthur, LLP

(57) ABSTRACT

A hair dryer includes a body having an air inlet and an air outlet, a fan for generating air flow from the air inlet to the air outlet, a heater for heating the air flow, and an attachment secured to the body and in communication with the air outlet to receive the air flow. A plurality of openings through which the air flow blows is formed in a concave surface which is sized and shaped for receiving a convex-shaped hair brush. The body includes a base portion adapted to support the hair dryer in a vertical orientation on a horizontal support surface so that the dryer can be utilized with hands free operation. The body also includes a grip portion between the base portion and the attachment that forms a cylindrically-shaped hand grip. Vertical central axes of the attachment, the grip portion, and the base portion are coaxial.

17 Claims, 8 Drawing Sheets

HAIR DRYER

CROSS-REFERENCE TO RELATED APPLICATIONS

This Application claims the priority benefit of U.S. Provisional Patent Application No. 61/247,987 filed on Oct. 2, 2009, the disclosure of which is expressly incorporated herein in its entirety by reference.

STATEMENT REGARDING FEDERALLY SPONSORED RESEARCH

Not Applicable

PARTIES TO JOINT RESEARCH AGREEMENT

Not Applicable

REFERENCE TO APPENDIX

Not Applicable

FIELD OF THE INVENTION

The field of the invention generally relates to hair dryers and, more specifically, relates to hand-held hair dryers.

BACKGROUND OF THE INVENTION

Professional and retail hand-held hair dryers or blow dryers for drying hair are typically gun shaped. These gun-type hair dryers put the hand of the hair stylist in an awkward position. The hand and wrist is bent downward at an angle of about 35 degrees which creates stress on the wrist and fatigue on the shoulder due to the elevation. Professional and retail hand-held blow dryers for drying hair also typically have an air outlet with a round circumference that gives no specific direction of air flow. As a result, the air flow blows hair all over the head.

Accordingly, there is a need in the art for hand-held hair dryer with improved ergonomics, ease of use, and/or performance.

SUMMARY OF THE INVENTION

Disclosed herein is a hand-held hair dryer which addresses one or more issues in the related art. According to one aspect of the invention, there is disclosed herein a hair dryer comprising, in combination, a body having an air inlet and an air outlet, a fan disposed inside the body for generating air flow from the air inlet to the air outlet, a heater disposed inside the body for heating the air flow, and an attachment engaged with the body in communication with the air outlet to receive the air flow therein. The attachment has a central axis, a surface concave in a cross-section perpendicular to the central axis and having a plurality of openings through which the air flow blows.

According to another aspect of the invention, there is disclosed herein a hair dryer comprising, in combination, a body having an air inlet and an air outlet, a fan disposed inside the body for generating air flow from the air inlet to the air outlet, a heater disposed inside the body for heating the air flow, and an attachment engaged with the body in communication with the air outlet to receive the air flow therein and having a plurality of openings through which the air flow blows. The body includes a base portion adapted to support the hair dryer in a vertical orientation on a horizontal support surface.

According to yet another aspect of the invention, there is disclosed herein a hair dryer comprising, in combination, a body having an air inlet and an air outlet, a fan disposed inside the body for generating air flow from the air inlet to the air outlet, a heater disposed inside the body for heating the air flow, and an attachment engaged with the body in communication with the air outlet to receive the air flow therein and having a plurality of openings through which the air flow blows and a central axis. The body includes a base portion having a central axis and adapted to support the hair dryer in a vertical orientation on a horizontal support surface. The air inlet is located at a lower end of the base portion and the base portion is provided with feet to space the air inlet above the support surface. The body includes a grip portion having a central axis and secured to an upper end of the base portion, and wherein the body forms a cylindrically-shaped hand grip about the central axis of the grip portion. The central axis of the attachment, the central axis of the grip portion and the central axis of the base portion are coaxial.

From the foregoing disclosure and the following more detailed description of various preferred embodiments it will be apparent to those skilled in the art that the present invention provides a significant advance in the technology of hair dryers. Particularly, the invention disclosed herein provides an ergonomic hair dryer with improved performance and ease of use. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 2:
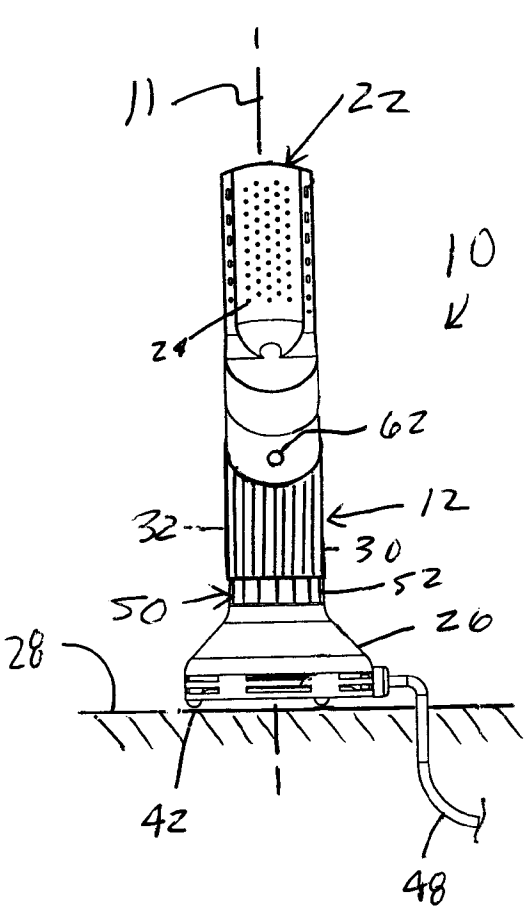
FIG. 2 is a front elevational view of the hair dryer of FIG. 1.
Figure 1:
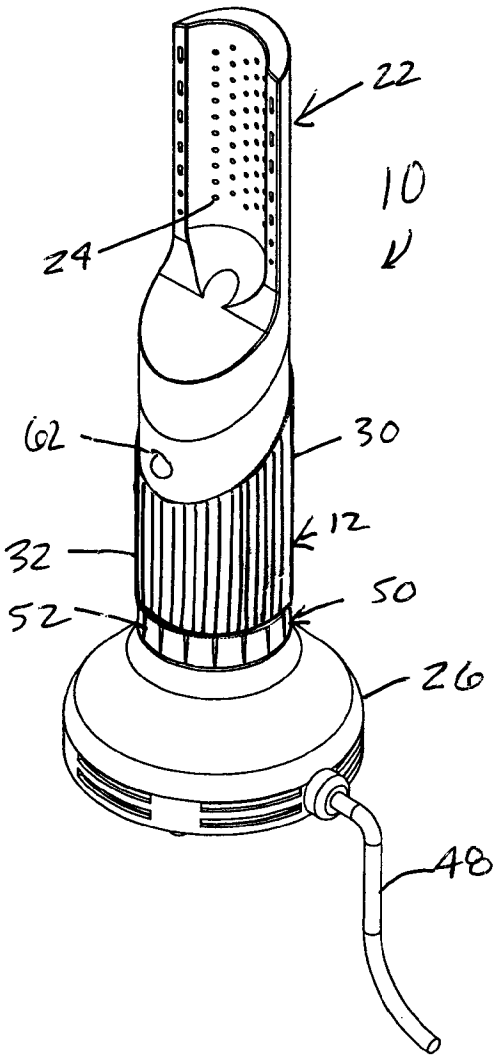
FIG. 1 is a perspective view of a hand-held hair dryer according to the present invention.
Figure 3:
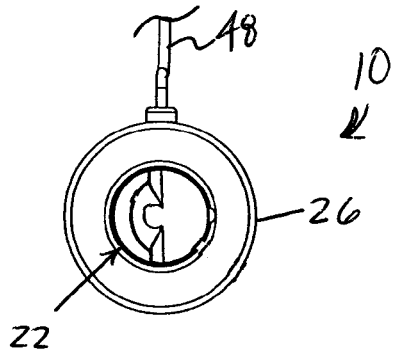
FIG. 3 is a top plan view of the hair dryer of FIGS. 1 and 2.
Figure 5:
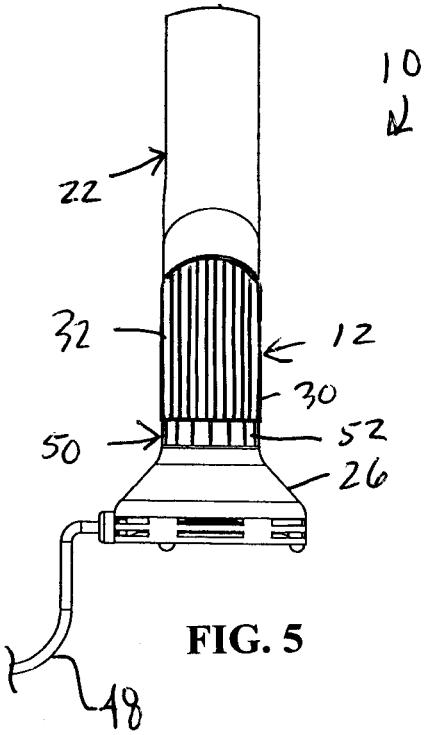
FIG. 5 is a rear elevational view of the hair dryer of FIGS. 1 to 4.
Figure 4:
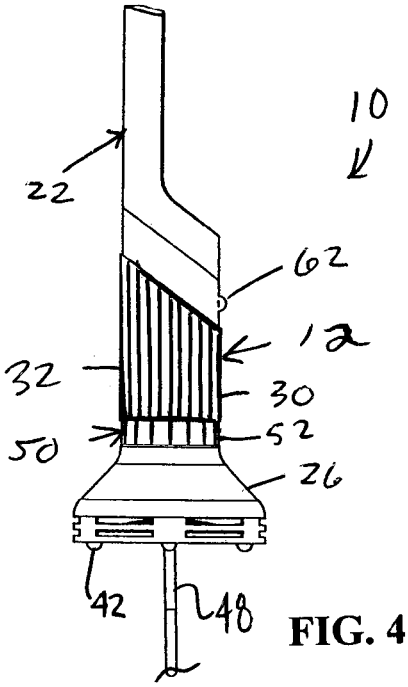
FIG. 4 is a right-side elevational view of the hair dryer of FIGS. 1 to 3.
Figure 6:
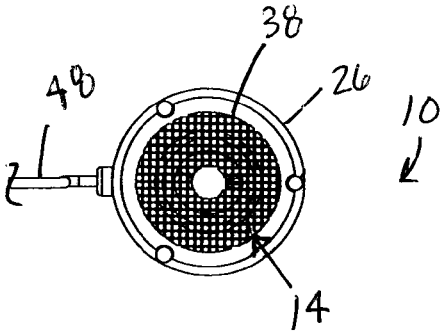
FIG. 6 is a bottom plan view of the hair dryer of FIGS. 1 to 5.
Figure 7:
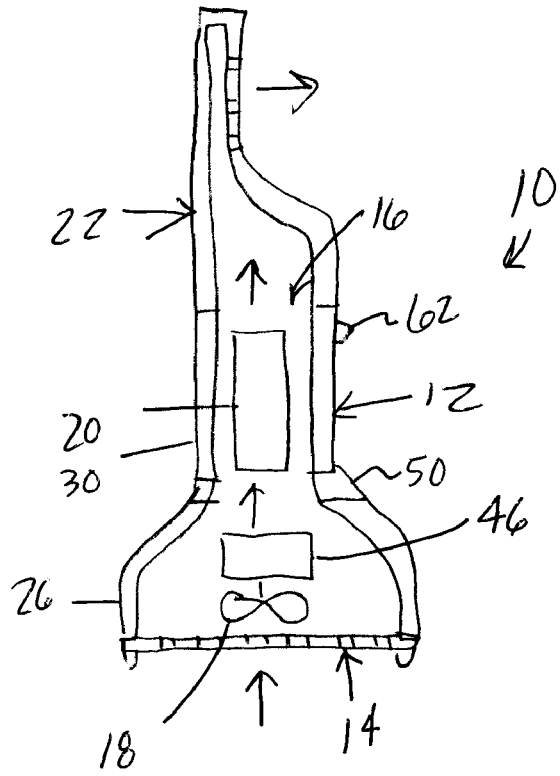
FIG. 7 is a diagrammatic view showing the passage of air through the hair dryer of FIGS. 1 to 6.

It should be understood that the appended drawings are not necessarily to scale, presenting a somewhat simplified representation of various preferred features illustrative of the basic principles of the invention. The specific design features of the hand-held hair dryers as disclosed herein, including, for example, specific dimensions, orientations, and shapes of the various components will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the hair dryer illustrated in the drawings. In general, up or upward refers to an upward direction generally in the plane of the paper in FIG. 2 and down or downward refers to a downward direction generally in the plane of the paper in FIG. 2. Also in general, fore or forward refers to a direction generally out of the plane of the paper in FIG. 2 and aft, rear, or rearward refers to a direction generally into the plane of the paper in FIG. 2.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved hair dryers disclosed herein. The following detailed discussion of various alternative and preferred embodiments will illustrate the general principles of the invention with reference to preferred embodiments. Other embodiments suitable for other applications will be apparent to those skilled in the art given the benefit of this disclosure.

Referring now to the drawings, FIGS. 1 to 8 show a hand-held blow dryer or hair dryer 10 according to a preferred embodiment of the present invention. The illustrated hair dryer 10 includes a body 12 having an air inlet 14 and an air outlet 16, a fan 18 disposed inside the body 21 for generating air flow from the air inlet 14 to the air outlet 16, a heater 20 disposed inside the body 12 for heating the air flow, and a detachable attachment 22 engaged with the body 12 in communication with the air outlet 16 to receive the air flow therein and having a plurality of openings 24 through which the air flow blows. The illustrated body 12 includes a base portion 26 adapted to support the hair dryer in a vertical orientation on a horizontal support surface 28 and a grip portion 30 secured to an upper end of the base portion 26 and forming a cylindrically-shaped hand grip 32.

As best shown in FIGS. 9 to 12, the illustrated base portion or base 26 is generally cylindrical shaped about a vertically-extending central axis 34. The illustrated base portion 26 includes a generally tubular-shaped, hollow housing 36 having openings at its lower and upper ends. The opening at the lower end forms the air inlet or air intake 14. The illustrated air inlet 14 is provided with a grate 38 to prevent the intake of undesired material from entering the hair dryer 10 in the air stream entering the air inlet 14. The upper end is provided with a reduced diameter portion 40 for connecting the grip portion 30 thereto. The housing 36 can comprise any suitable material such as plastic.

The illustrated base portion 26 is adapted to rest on a horizontal support surface 28 such as a counter to support the hair dryer 10 in a vertical or upright position. A plurality of feet 42 is provided on the bottom side of the base portion 26 to provide an air gap between the air inlet 14 and the support surface 28 upon which the hair dryer 10 is supported. The illustrated base portion 26 includes three spaced apart feet 42 but any other suitable quantity can alternatively be utilized. The feet 42 can comprise rubber or any other suitable material which will not damage countertops. The illustrated base 26 also includes additional or auxiliary air inlets 44 located about the circumference of the side wall of the base portion 26 adjacent the bottom surface. The illustrated auxiliary air inlets 44 are in the form of horizontally extending slots but any other suitable configuration can alternatively be utilized.

The illustrated base portion 26 houses a blower assembly which includes the fan 18 and an electric motor 46 which rotates the fan 18 to pull air in through the air inlet 14 and out through the opening in the upper end. A power cord or cable 48 extends into the base portion 26 and is in electrical communication with the electric motor 46 via a main on-off switch 50. The illustrated power cable 48 extends through an opening in the side wall of the base portion 26 and is provided with a suitable grommet. Configured in this manner, the power cord 48 does not interfere with the blow dryer 10 being vertically supported by the base portion 26 on a countertop or other support surface 28.

As best shown in FIGS. 18 to 21, the illustrated main on-off switch 50 includes a generally tubular shaped roller 52 having a circular cross-section about a vertically-extending central axis 54. The illustrated roller 52 is located between the base portion 26 and the grip portion 30 and is coaxial with both the base portion 26 and the grip portion 30. The illustrated roller 52 enables the user to selectively turn power on and off, and thus start and stop the flow of air through the hair dryer 10, by rotating or pivoting the roller 52 about the central axis 54. The illustrated roller 52 is provided with a pair of inwardly extending fingers 55 that interact with other components of the switch 50 in a known manner. It is noted that any other suitable type of switch 50 can alternatively be utilized and/or any other suitable location for the switch 50 can alternatively be utilized. The roller 52 can comprise any suitable material such as plastic.

As best shown in FIGS. 13 to 17, the illustrated grip portion 30 includes a generally tubular shaped housing 56 having a circular cross-section about a vertically extending central axis 58. The open lower end is adapted to be secured to secured to the reduced diameter portion 40 of the base portion 26 so that the grip portion 30 is coaxial with the base portion 26 is open to receive air flow from the base portion 26. The upper end is adapted to detachably receive the attachment 22 so that the grip portion 30 is coaxial with the attachment 22 and is open to provide the air flow to the attachment 22. The housing 56 can comprise any suitable material such as plastic.

The illustrated grip portion 30 forms the cylindrical-shaped handle or hand grip 32 on its outer surface which is coaxial with the grip portion 30. The hand grip 32 is sized so that it can be held in the hand of the user. The illustrated hand grip 32 has a diameter of about 2 inches but any other suitable size can alternatively be utilized. The hand grip 32 is preferably provided with a slip-resistant surface. The illustrated hand grip 32 is provided with a plurality of vertically extending and circumferentially spaced-apart fins or ribs 60. The illustrated hand grip 32 is provided with 190 ribs 60 but any other suitable quantity can alternatively be utilized. The illustrated ribs 60 are about 0.02 inches wide and about 0.05 inches deep and are spaced apart about 0.04 inches but any other suitable size and/or spacing can alternatively be utilized. The ribs 60 preferably comprise a resiliently deformable material so that they deform when the user grasps the hand grip 32. The ribs 60 can comprise silicone or any other suitable material.

The illustrated grip portion 30 houses the electric heater 20 which heats the air flow as it flow passes through the grip portion 30. A hot air on-off switch 62 communicates the heater 20 with the power cord 48. Preferably, power can be supplied to the heater 20 only when the electric motor 46 is powered and the fan 18 is driving the air flow past the heater 20. The hot air on-off switch 62 enables the use to turn the heater 20 on and off to start and stop the heating of air flowing through the hair dryer 10. Thus, either heated or unheated air can be selectively expelled from the hair dryer 10. The illustrated hot air on-off switch 62 is a push-button switch located at the front of the grip portion 30 near the top of the grip portion 30. It is noted, however, that any other suitable type of switch 62 can alternatively be utilized and/or any other suitable location for the switch 62 can alternatively be utilized.

As best shown in FIGS. 22 to 26, the illustrated attachment 22 is in the form of a wand 22A having a generally cylindrical shaped lower end about a vertically-extending central axis 64. The lower end is adapted to be removably received on the upper end of the grip portion 30 and coaxial with the grip portion 30 so that the air flow exits the open upper end of the grip portion 30 and enters the open lower end of the attachment 22 to the hollow interior of the attachment 22. The upper end of the detachable wand 22A is closed and shaped like a near half tube with a concave-shaped forward-facing surface 66 (concave about a vertical axis). The illustrated surface 66 is concave in a horizontal cross-section perpendicular to the central axis 64 the plurality of openings 24 formed therein through which the air flow blows. The surface 66 is not concave in cross-sections parallel to the central axis 64. The illustrated surface 66 has a constant curvature in the vertical direction, the direction of the central axis 64, such that air blowing from the plurality of openings 24 is directed toward a vertically-extending line of curvature 67 for the surface 66 which is parallel to the central axis 64. The concave surface 66 is sized and shaped to be placed over a convex-shaped hair brush 72 so that the air flow is directed toward the center of the hair brush 72. The illustrated surface 66 has a radius of about 0.86 inches but any other suitable radius can alternatively be utilized.

The plurality of the spaced-apart openings 24 is provided in the concave surface 66 to allow the air flow to blow/project onto a person's hair. The illustrated openings 24 are each circular and of the same size but it is noted that any other suitable shape or size pattern can alternatively be utilized. The illustrated surface has 50 holes but any other suitable quantity can alternatively be utilized. The illustrated openings have a diameter of about 0.06 inches but any other suitable size can alternatively be utilized. Additionally, graduated obround slots 68 extend in the vertical direction in opposed vertically-extending, forward-facing, and laterally spaced-apart flat surfaces 70 located along lateral sides of the concave surface 66. The obround slots 68 increase in size in the vertical direction. The illustrated attachment 22 has 7 slots 68 on each side but any other suitable quantity of slots can alternatively be utilized. The illustrated slots 68 have a width of about 0.06 inches and lengths ranging from about 0.06 inches to about 0.193 inches long but any other suitable sizes can alternatively be utilized. The attachment 22 can comprise any suitable material such as plastic.

The hair dryer is sized for hand-held use. The hair dryer can have a total height of about 11.29 inches, a diameter of about 4 inches at the base portion 26, and a diameter of about 2 inches at the grip portion 30 but it is noted that any other suitable dimensions can alternatively be utilized.

Figure 8:
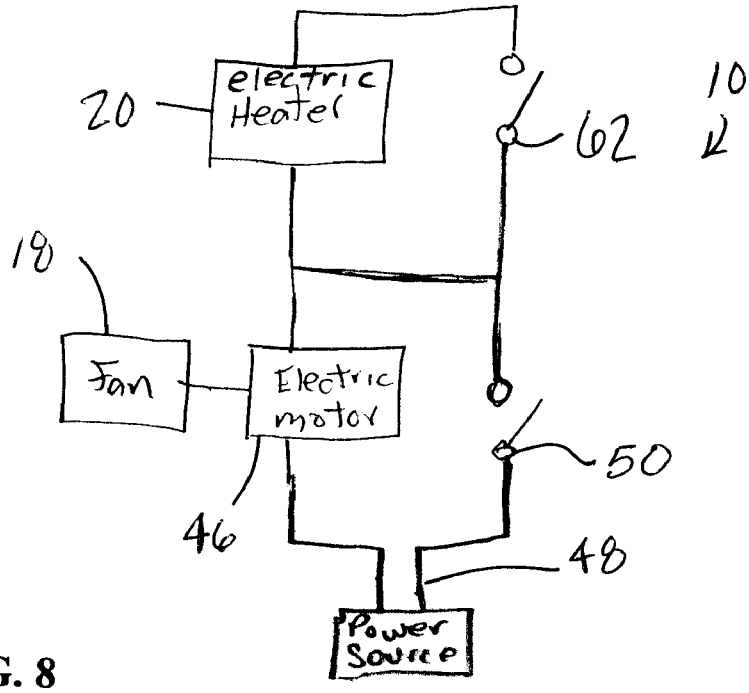
FIG. 8 is a schematic view of electrical components of the hair dryer of FIGS. 1 to 7.
Figure 9:
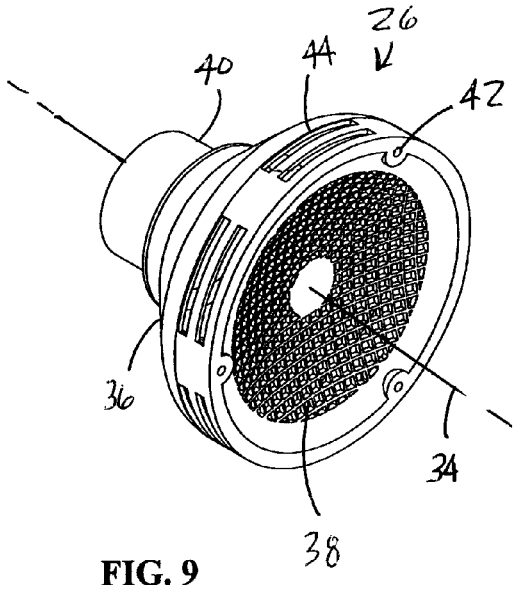
FIG. 9 is a perspective view of a base of the hair dryer of FIGS. 1 to 8.
Figure 12:
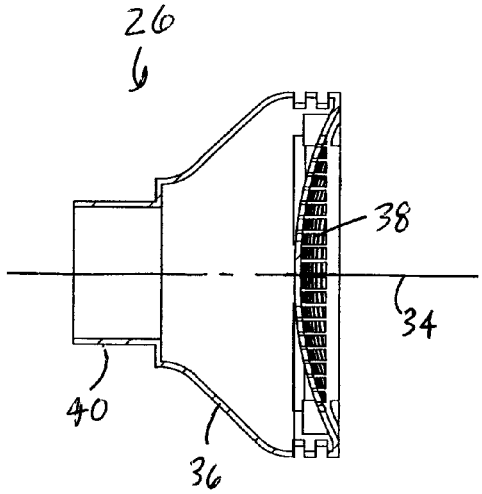
FIG. 12 is a cross-sectional view taken from line 12-12 of FIG. 10.
Figure 10:
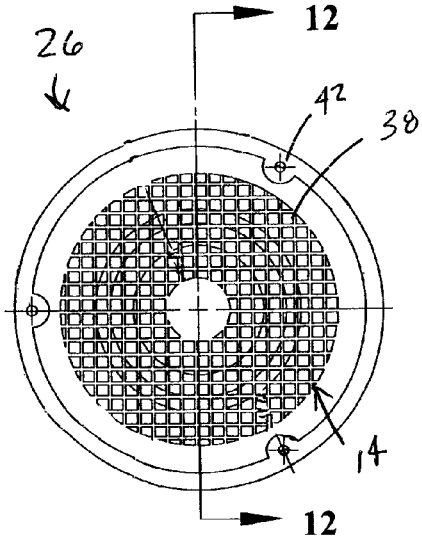
FIG. 10 is a bottom plan view of the base of FIG. 9.
Figure 11:
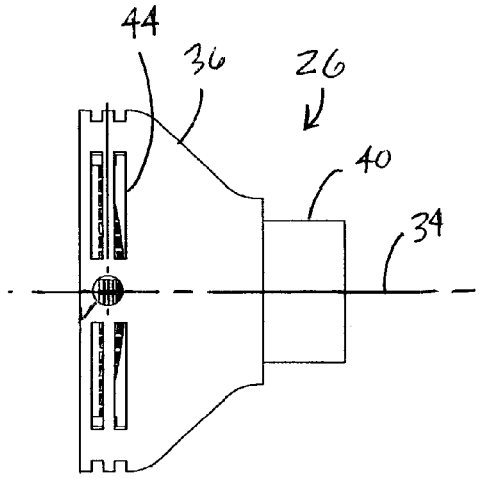
FIG. 11 is a left-side elevational view of the base of FIGS. 9 and 10.
Figure 13:
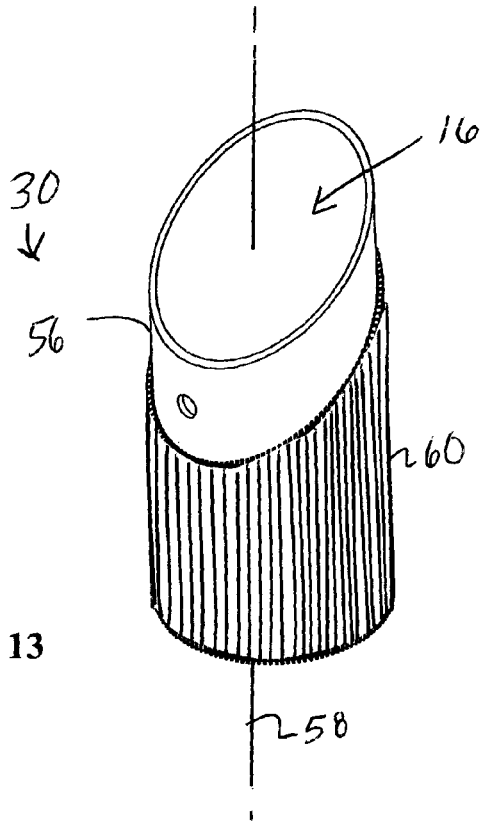
FIG. 13 is a perspective view of a hand grip of the hair dryer of FIGS. 1 to 8.
Figure 14:
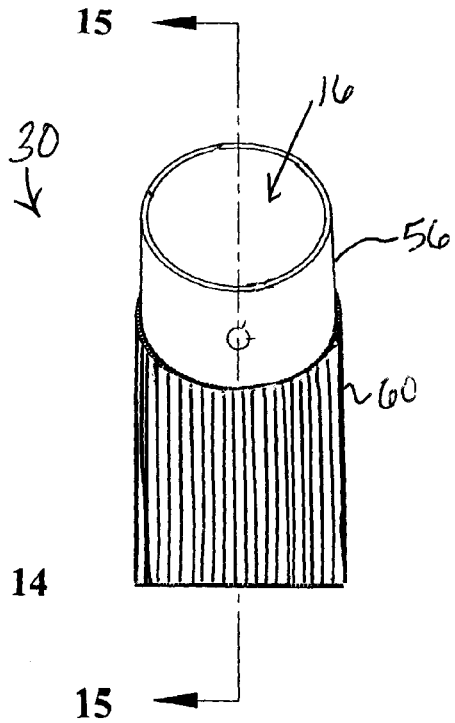
FIG. 14 is a front elevational view of the hand grip of FIG. 13.
Figure 15:
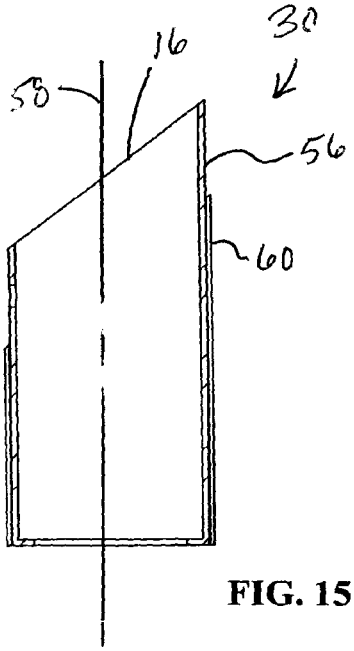
FIG. 15 is a cross-sectional view taken from line 15-15 of FIG. 14.
Figure 16:
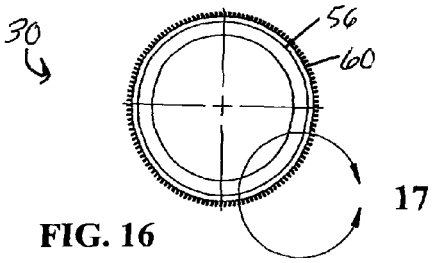
FIG. 16 is a top plan view of the hand grip of FIGS. 13 to 15.
Figure 17:
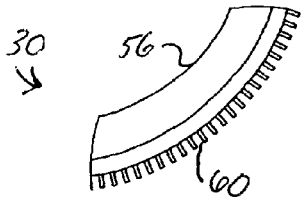
FIG. 17 is an enlarged fragmented view showing a portion of the hand grip in FIG. 16.
Figure 18:
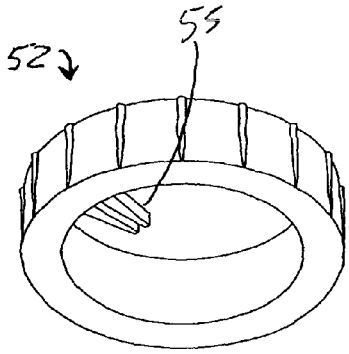
FIG. 18 is a perspective view of a switch roller of the hair dryer of FIGS. 1 to 8.
Figure 19:
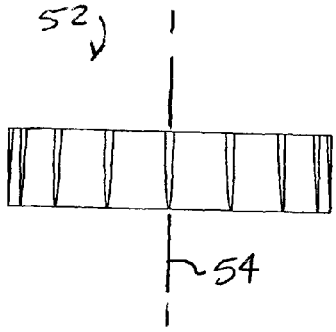
FIG. 19 is an elevational view of the switch roller of FIG. 18.
Figure 20:
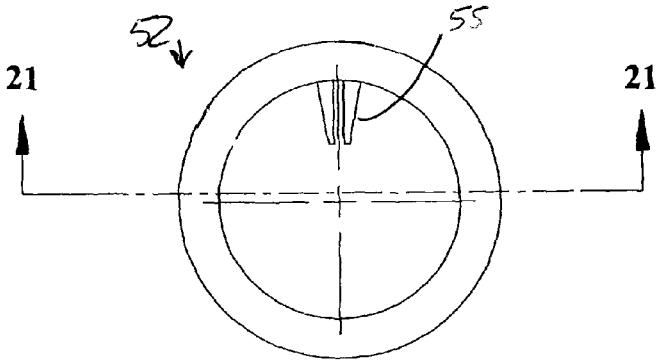
FIG. 20 is a top plan view of the switch roller of FIGS. 18 and 19.
Figure 21:
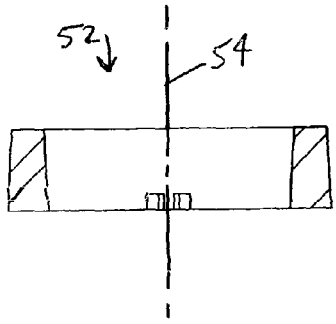
FIG. 21 is a cross-sectional view taken along line 21-21 of FIG. 20.
Figure 22:
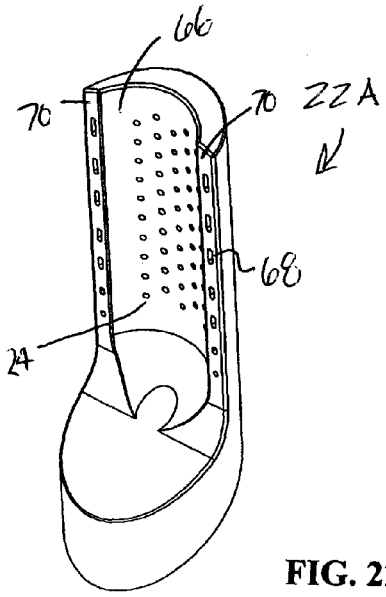
FIG. 22 is a perspective view of a detachable wand of the hair dryer of FIGS. 1 to 8.
Figure 23:
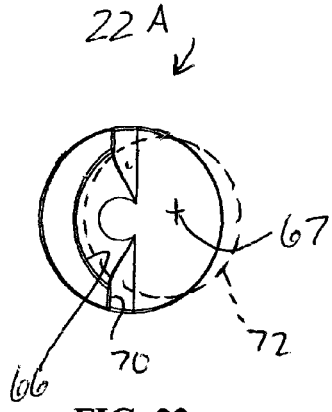
FIG. 23 is a top plan view of the detachable wand of FIG. 22.
Figure 24:
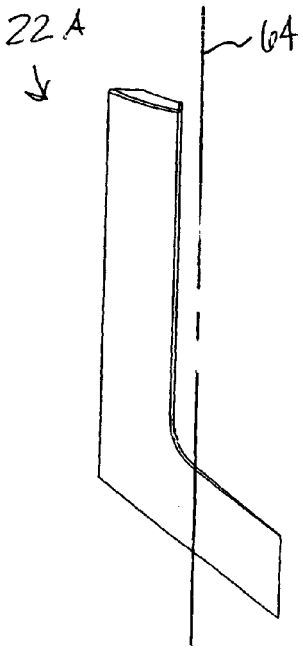
FIG. 24 is a right-side elevational view of the detachable wand of FIGS. 22 and 23.
Figure 25:
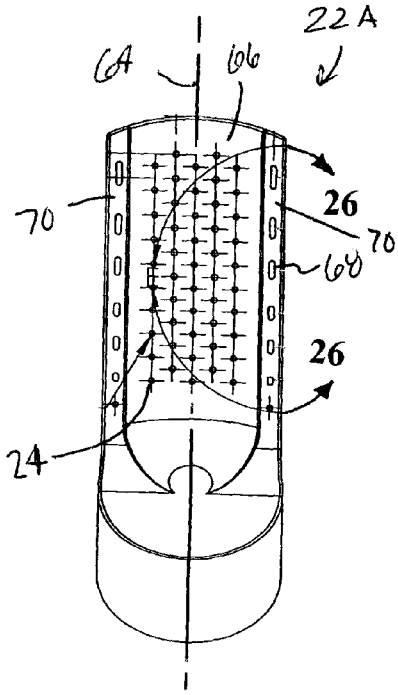
FIG. 25 is a front elevational view of the detachable wand of FIGS. 22 to 24.
Figure 26:
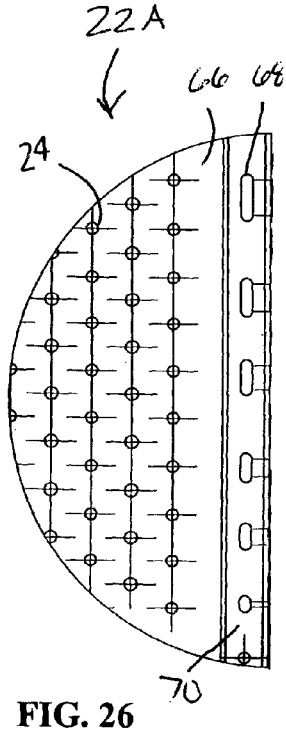
FIG. 26 is an enlarged fragmented view of a portion of the detachable wand of FIG. 25.

As best shown in FIG. 8, when the user activates the main switch 50 to power the electric motor 46, the fan 18 rotates to draw air upwardly into the base portion 26 through the inlet 14. If for some reason, the inlet 14 is blocked, air will flow in through the auxiliary inlets 44. The air flow continues upwardly through the base portion 26 so that it exits the top of the base portion 26 and enters bottom of the grip portion 30. The air flow continues upwardly through the grip portion 30 so that it exits the grip portion 30 through the air outlet 16 and enters the bottom of the attachment 22. As the air flow passes through the grip portion 30, the air flow is heated by the heater 20 if the hot air on-off switch 62 is at its on position to activate the heater 20. The airflow continues upwardly through the attachment 22 until it reaches the openings 24 and is discharged outwardly from the openings in a path generally horizontal to the vertically-extending central axis 11 of the hair dryer 10 (formed by the coaxial central axes 34, 56, 64 of the base portion 26, grip portion 30, and attachment 22). The discharged air also converges toward the vertical line of curvature 67 for the concave surface 66. The user activates the main switch 50 to turn off the motor 46 when the user desires to stop the flow of air.

Figure 27:
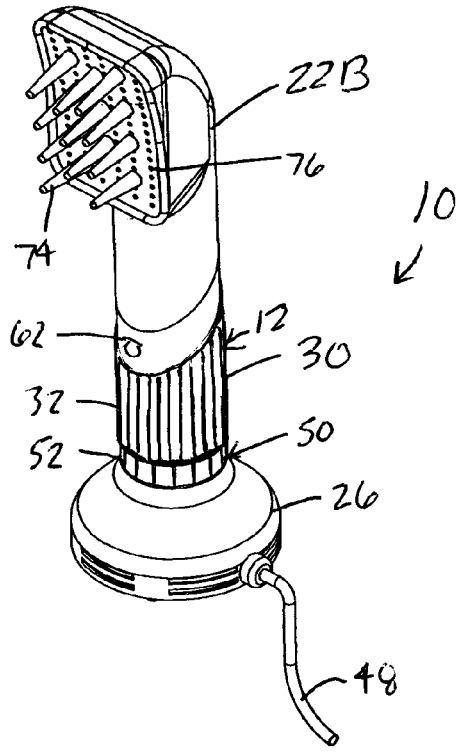
FIG. 27 is a perspective view of the hair dryer of FIGS. 1 to 8 but with a detachable brush secured in place of the detachable wand.
Figure 28:
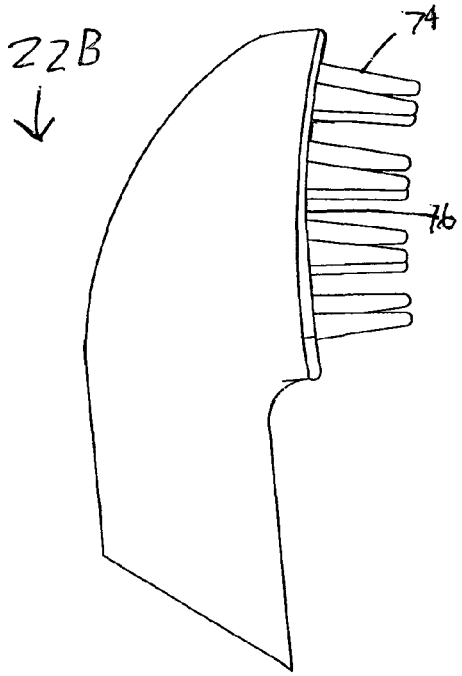
FIG. 28 is a right-side elevational view of the detachable brush of FIG. 27.
Figure 29:
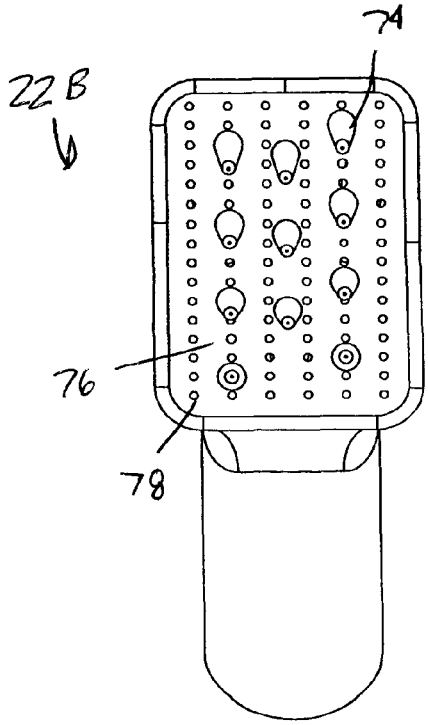
FIG. 29 is a front elevational view of the detachable brush of FIG. 28.

As best shown in FIGS. 27 to 29, the detachable wand 22A can be selectively replaced with other a detachable attachments such as the illustrated brush 22B. It is noted that any other suitable attachment can alternatively be utilized with the hair dryer 10. The illustrated detachable brush 22B has a plurality of brushing cones 74 located on a concave surface 76 (concave about a horizontal axis) having a plurality of exhaust air openings 78. The illustrated surface 76 has a radius of about 10.41 inches but any other suitable radius can alternatively be utilized. The illustrated brush 22B has 11 cones that are each about 1.25 inches long but it is noted that any other suitable quantity and/or size can alternatively be utilized. The illustrated brush 22B also has 85 of the openings which each have a diameter of about 0.093 inches but it is noted that any other suitable quantity and/or size can alternatively be utilized. The illustrated surface 76 is recessed below a raised rim extending about the entire periphery of the surface 76.

It is apparent from the foregoing disclosure that the hair dryer 10 can be held by a stylist in a parallel position to the head, one hand on the hair dryer 10 and one hand on the brush 72 thus relieving stress on the wrist and lowering the shoulder. It is also apparent that an even stream of air flow which is concave in shape is provided to cooperate with a convex shape of a hair brush 72 and give hair more volume and direction. It is further apparent that the hair dryer 10 can be positioned in an upright position on a counter for hands-free operation. This is particularly useful for people who cannot lift their hands above their head.

From the foregoing disclosure and detailed description of certain preferred embodiments, it will be apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A hand-held hair dryer comprising, in combination:

a cylindrically-shaped body having a central axis extending between upper and lower ends of the body, an air inlet located at the lower end of the body, and an air outlet opposed to the air inlet and located at the upper end of the body;

a fan disposed inside the body for generating air flow from the air inlet to the air outlet;

a heater disposed inside the body for heating the air flow;

wherein the body includes a base portion located at a lower end of the body and adapted to support the hair dryer on a horizontal support surface with the central axis of the body in a vertical orientation such that the air inlet faces downward and the air outlet faces upward; and wherein the body includes a hand grip located between the air inlet and the air outlet and the hand grip is sized so that the hand grip can be held in the hand of a user for hand-held use of the hair dryer.

2. The hair dryer according to claim 1, wherein the base portion is provided with feet to space the air inlet above the support surface.

3. The hair dryer according to claim 1, wherein the hand grip is cylindrically-shaped having a central axis.

4. The hair dryer according to claim 3, wherein the central axis of the hand grip is coaxial with the central axis of the body.

5. The hair dryer according to claim 1, further comprising an attachment engaged with the upper end of the body in communication with the air outlet to receive the air flow, and wherein the attachment is detachably secured to the body.

6. A hand-held hair dryer comprising, in combination:

a cylindrically-shaped body having a central axis extending between upper and lower ends of the body, an air inlet located at the lower end of the body, and an air outlet opposed to the air inlet and located at the upper end of the body;

a fan disposed inside the body for generating air flow from the air inlet to the air outlet;

a heater disposed inside the body for heating the air flow;

wherein the body includes a base portion located at a lower end of the body and adapted to support the hair dryer on a horizontal support surface with the central axis of the body in a vertical orientation such that the air inlet faces downward and the air outlet faces upward;

wherein the air inlet is located at a lower end of the base portion and the base portion is provided with feet to space the air inlet above the support surface;

wherein the body includes a grip portion forming a cylindrically-shaped hand grip having a central axis;

wherein the hand grip is located between the air inlet and the air outlet and the hand grip is sized so that the hand grip can be held in the hand of a user for hand-held use of the hair dryer; and wherein the central axis of the hand grip and the central axis of the body are coaxial.

7. The hair dryer according to claim 1, wherein the air inlet and the air outlet are each located about the central axis of the body.

8. The hair dryer according to claim 1, wherein the upper end of the base portion has a reduced diameter portion connecting the hand grip.

9. The hair dryer according to claim 1, wherein the upper end of the body is adapted to receive removable attachments.

10. The hair dryer according to claim 1, wherein a power cord extends through a side wall of the body so that the power cord does not interfere with the hair dryer being vertically supported by the base portion.

11. The hair dryer according to claim 2, wherein the feet are circumferentially spaced apart about the air inlet.

12. The hair dryer according to claim 6, further comprising an attachment engaged with the upper end of the body in communication with the air outlet to receive the air flow, and wherein the attachment is detachably secured to the body.

13. The hair dryer according to claim 6, wherein the air inlet and the air outlet are each located about the central axis of the body.

14. The hair dryer according to claim 6, wherein the upper end of the base portion has a reduced diameter portion connecting the hand grip.

15. The hair dryer according to claim 6, wherein the upper end of the body is adapted to receive removable attachments.

16. The hair dryer according to claim 6, wherein a power cord extends through a side wall of the body so that the power cord does not interfere with the hair dryer being vertically supported by the base portion.

17. The hair dryer according to claim 6, wherein the feet are circumferentially spaced apart about the air inlet.

* * * * *